US008992158B2

(12) United States Patent
Springer et al.

(10) Patent No.: US 8,992,158 B2
(45) Date of Patent: Mar. 31, 2015

(54) APPARATUS AND METHOD FOR REINFORCEMENT OF A LOAD BEARING STRUCTURE

(75) Inventors: Steven Springer, Aurora, IL (US); Jason Musheno, Batavia, IL (US)

(73) Assignee: Caterpillar Inc., Peoria, IL (US)

( * ) Notice: Subject to any disclaimer, the term of this patent is extended or adjusted under 35 U.S.C. 154(b) by 828 days.

(21) Appl. No.: 13/226,577

(22) Filed: Sep. 7, 2011

(65) Prior Publication Data

US 2013/0058748 A1 Mar. 7, 2013

(51) Int. Cl.
*E02F 9/14* (2006.01)
*E02F 3/38* (2006.01)

(52) U.S. Cl.
CPC ..... *E02F 3/38* (2013.01)
USPC ..... 414/722; 414/727; 52/117; 52/650.1; 52/843

(58) Field of Classification Search
USPC ..... 414/722, 727; 52/117, 650.1, 843
See application file for complete search history.

(56) References Cited

U.S. PATENT DOCUMENTS

| | | | | |
|---|---|---|---|---|
| 1,893,721 | A * | 1/1933 | Wahlberg | 280/796 |
| 3,103,262 | A * | 9/1963 | Handley | 52/650.1 |
| 4,439,089 | A | 3/1984 | Anderson et al. | |
| 4,576,543 | A | 3/1986 | Kuchyt et al. | |
| 4,973,214 | A | 11/1990 | Schupback et al. | |
| 4,993,269 | A * | 2/1991 | Guillaume et al. | 73/861.53 |
| 5,152,659 | A | 10/1992 | Waka | |
| 7,165,929 | B2 * | 1/2007 | Janes et al. | 414/722 |
| 7,654,571 | B2 * | 2/2010 | Gabbianelli et al. | 280/781 |
| 7,762,758 | B2 * | 7/2010 | Sharpe et al. | 414/722 |
| 7,828,505 | B2 * | 11/2010 | Sakada et al. | 414/722 |
| 8,382,398 | B2 * | 2/2013 | Stauffacher et al. | 405/111 |
| 2003/0153938 | A1 * | 8/2003 | Masury et al. | 606/167 |
| 2010/0119344 | A1 | 5/2010 | Nabata et al. | |

FOREIGN PATENT DOCUMENTS

| | | |
|---|---|---|
| JP | 59170332 | 9/1984 |
| JP | 2006257839 | 9/2006 |

* cited by examiner

*Primary Examiner* — Scott Lowe
(74) *Attorney, Agent, or Firm* — Miller, Matthias & Hull LLP

(57) ABSTRACT

A reinforcement device for a load bearing structure is disclosed. The reinforcement device may include a tubular wall including a first end, a second end, a throat disposed between the first end and the second end, and a curved portion disposed between the throat and each of the first end and the second end. The tubular wall may also include a first dimension at the throat and a second dimension at each of the first and second ends, the first dimension being smaller than the second dimension.

7 Claims, 4 Drawing Sheets

APPARATUS AND METHOD FOR REINFORCEMENT OF A LOAD BEARING STRUCTURE

TECHNICAL FIELD

The present disclosure relates to a reinforcement apparatus for a load bearing structure, in particular, a reinforcement apparatus for a box-beam-type structure configured to enhance rigid support against torsional loads while allowing external access to welded portions.

BACKGROUND

Implement carrying linkages for excavators and other similar machines may include multiple load bearing structures, such as a boom and/or a stick, which may be fabricated from a number of steel plates joined together by welds forming a box beam (also referred to as a box section). The box beam includes a hollow region enclosed by the steel plates. The box beam structures may be subjected to torsional loads during use of the machine, which may result in deformation and/or failure the box beam structure.

One solution to provide enhanced rigidity to a box beam structure subject to torsional loads is to weld baffle plates within the box beam at various locations. However, manufacturing a box beam structure having such internally welded baffle plates requires a significant amount of tooling, welding equipment, and process time. Additionally, because the baffle plates are internal to the structure, visual inspection and repair of the baffle plate welds require cutting into the box beam to access the baffle plates and their associated welds then repairing the box beam after the inspection and/or repair has been completed.

U.S. Pat. No. 5,152,659 discloses increasing torsional rigidity of an excavator boom by including a cylindrical cross-tie member penetrating through and welded to the side plates of the boom assembly. However, the cylindrical cross-tie member does not provide for diffusion of torsional loads or distribution of the loads into the boom structure.

U.S. Pat. No. 4,439,089 discloses a loader boom arm assembly having a pair of box section boom arms and a cross tube welded to the inboard sidewalls of each of the box section boom arms. In this configuration, the cross tube is not enclosed within a structure and simply provides a rigid connection between two box section boom arms.

Japanese Patent JP 59170332A discloses construction of a boom without reinforcing plates or partition walls by welding upper and lower intermediate brackets to the left- and right-handed boom cylinder brackets. However, this configuration is internal to the box section and would require removal of the boom cylinders and/or cutting into the box section to inspect and/or repair the welds.

The disclosed apparatus and method for reinforcing a load bearing structure is intended to overcome one or more of the problems set forth above and/or other problems of the prior art.

SUMMARY OF THE INVENTION

One aspect of the present disclosure is directed to a reinforcement apparatus for a load bearing structure. The reinforcement apparatus may include a tubular wall including a first end, a second end, a throat disposed between the first end and the second end, and a stress diffuser disposed between the throat and each of the first end and the second end The tubular wall may include a first thickness at the throat and a second thickness at each of the first and second ends.

Another aspect of the present disclosure is directed to a linkage assembly for a machine including a load bearing structure and a reinforcement apparatus. The load bearing structure may include a first sidewall including a first aperture and a second sidewall including a second aperture, the first sidewall being spaced apart from the second sidewall. The reinforcement apparatus being disposed between the first sidewall and the second sidewall includes a tubular wall including a first end, a second end, a throat portion disposed between the first end and the second end, and a stress diffuser portion disposed between the throat portion and each of the first end and the second end. The tubular wall may include a first dimension at the throat portion and a second dimension at each of the first and second ends, the first dimension being smaller than the second dimension. The first end is arranged in cooperation with the first aperture and the second end arranged in cooperation with the second aperture.

Yet another aspect of the present disclosure is directed to a method for reinforcing a load bearing structure including a first sidewall including a first aperture and a second sidewall including a second aperture. The method including the steps of placing a reinforcing apparatus between the first sidewall and the second sidewall, the reinforcing apparatus including a tubular wall including a first end and a second end, wherein the first end is placed in cooperation with the first aperture and the second end is placed in cooperation with the second aperture, joining the first end to the first sidewall, and joining the second end to the second sidewall.

DETAILED DESCRIPTION

Figure 1:
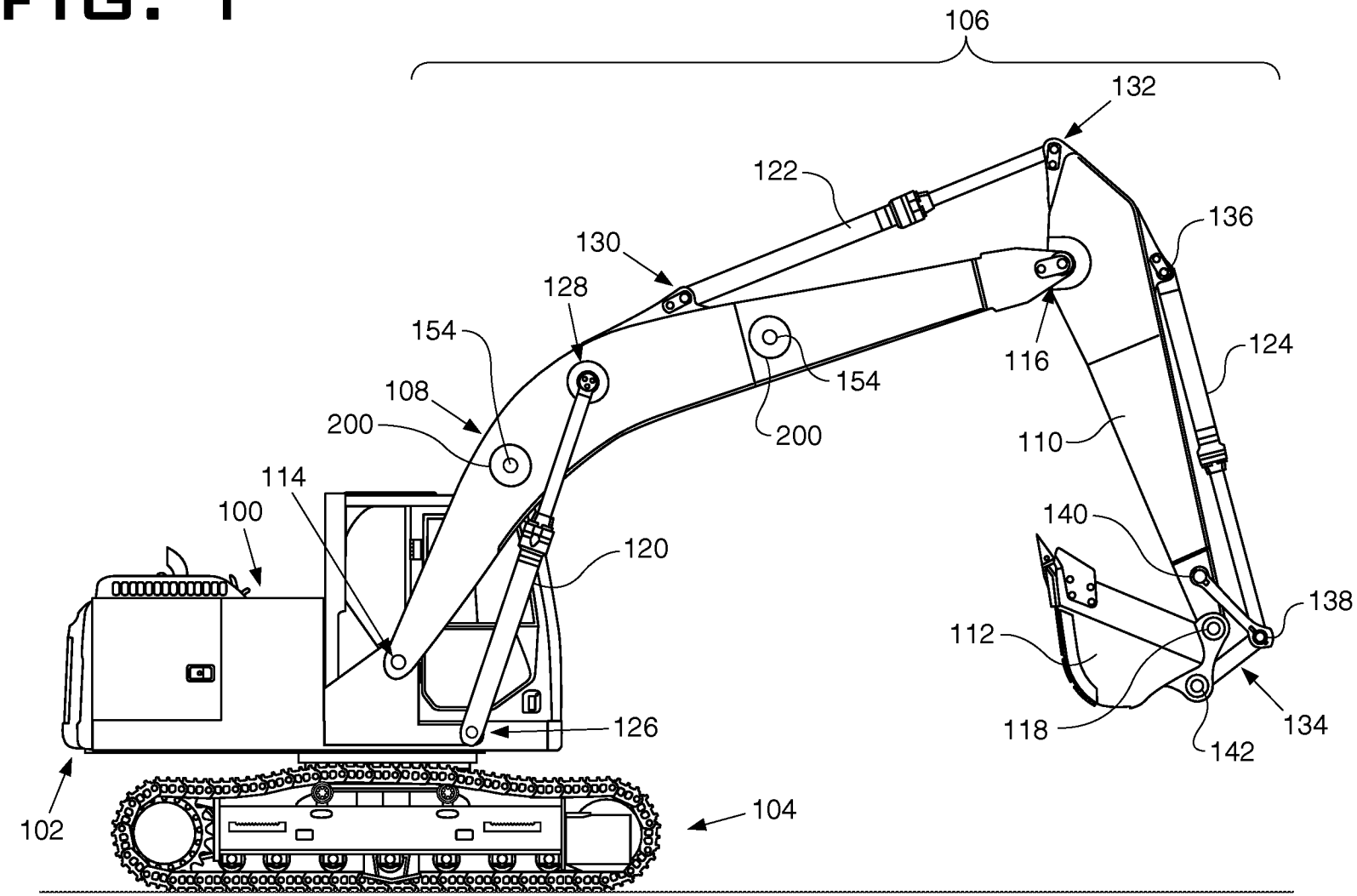
FIG. 1 is a diagrammatic side view of an excavator including a linkage including a boom in accordance with an exemplary embodiment of the present disclosure.

FIG. 1 shows an exemplary machine 100 having a body 102 mounted on an undercarriage 104. Although in this exemplary embodiment the machine 100 is shown as an excavator, the machine 100 could be a backhoe, crane, loader or any similar machine. The machine 100 includes a linkage 106 having mating components, such as, for example, a boom 108, a stick 110, and a work implement 112. The boom 108 may be connected to the body 102 at a pinned boom joint 114 that allows the boom 108 to pivot about the boom joint 114. The stick 110 may be connected to the boom 108 at a pinned stick joint 116, and the work implement 112 may be connected to stick 110 at a pinned work implement joint 118.

Movement of the linkage 106 may be achieved by a series of hydraulic cylinder actuators 120, 122 and 124 coupled to the linkage 106 as is known in the art. For example, a boom actuator 120 may be coupled between the body 102 and the boom 108 by way of pinned boom actuator joints 126 and 128. The boom actuator joints 126 and 128 are configured to allow the boom actuator 120 to pivot relative to the boom 108 and the body 102 during movement of the boom 108.

A stick actuator 122 may be coupled between the boom 108 and the stick 110 by way of pinned stick actuator joints 130 and 132 to allow the stick actuator 122 to pivot relative to the boom 108 and stick 110 during movement of the stick 110. Further, a work implement actuator 124 may be coupled between the stick 110 and mechanical links 134 coupled to the work implement 112. The work implement actuator 124 may be connected to the stick 110 and mechanical links 134 at work implement actuator joints 136 and 138, respectively. The mechanical links 134 may also include link joints 140, 142 attaching the mechanical links 134 to the work implement 112 and the stick 110.

The work implement 112 may be used to engage the ground or other material in a digging action to move and/or remove earth or other material. Such digging action subjects the work implement 112 to forces which may be transmitted to the stick 110 and the boom 108. Such forces may have a vector oriented laterally and/or offset to a long axis of the stick 110 and/or boom 108, resulting in a torsional load being applied.

Figure 2:
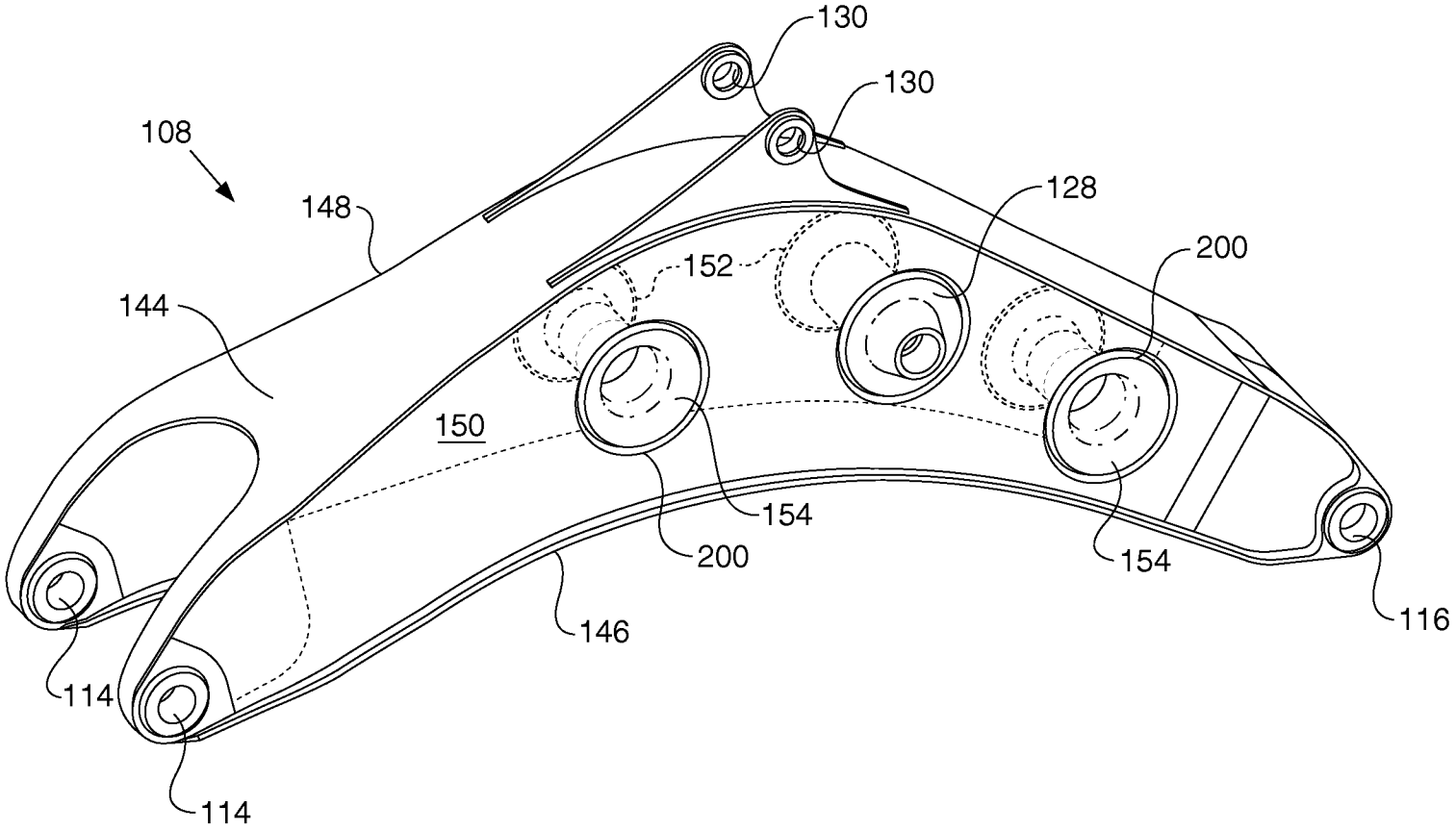
FIG. 2 is a perspective view of a boom including reinforcement apparatuses in accordance with an exemplary embodiment of the present disclosure.

FIG. 2 shows a boom 108 including a top plate 144, a bottom plate 146, and a pair of spaced apart sidewalls 148, 150 attached to the top plate 144 and the bottom plate 146, for example, by a welding process. The top plate 144, bottom plate 146, and sidewalls 148, 150 form a box-beam-type structure which defines a hollow chamber within the boom 108 which is enclosed by plates 144, 146, 148, 150.

The boom 108 further includes a reinforcement apparatus 200. The exemplary embodiment of FIG. 2 depicts an L-shaped boom 108 including two reinforcement apparatus 200, one reinforcement apparatus positioned in each leg of the boom 108. Also, each reinforcement apparatus 200 may be positioned in line with the neutral axis of the boom 108. Alternatively, the reinforcement apparatus 200 of the present disclosure may be positioned at any location within the boom 108 relative to the neutral axis, depending on the location requiring reinforcement. Further, although the reinforcement apparatuses are shown in FIG. 2 as being the same size, it is contemplated that different reinforcement devices in a given load bearing structure may be of different sizes, depending on the application. For example, the forward reinforcement device shown in FIG. 2 may be smaller than the rearward reinforcement device. The reinforcement apparatuses 200 of the present disclosure may be located at predetermined locations in a load bearing structure as determined, for example, by finite element analysis or other techniques known in the art. As should be apparent, the number, positioning, and size of reinforcement apparatuses 200 may be varied according to a particular application and may be applied to any box beam structure without departing from the scope of the present disclosure and the appended claims.

Figure 3:
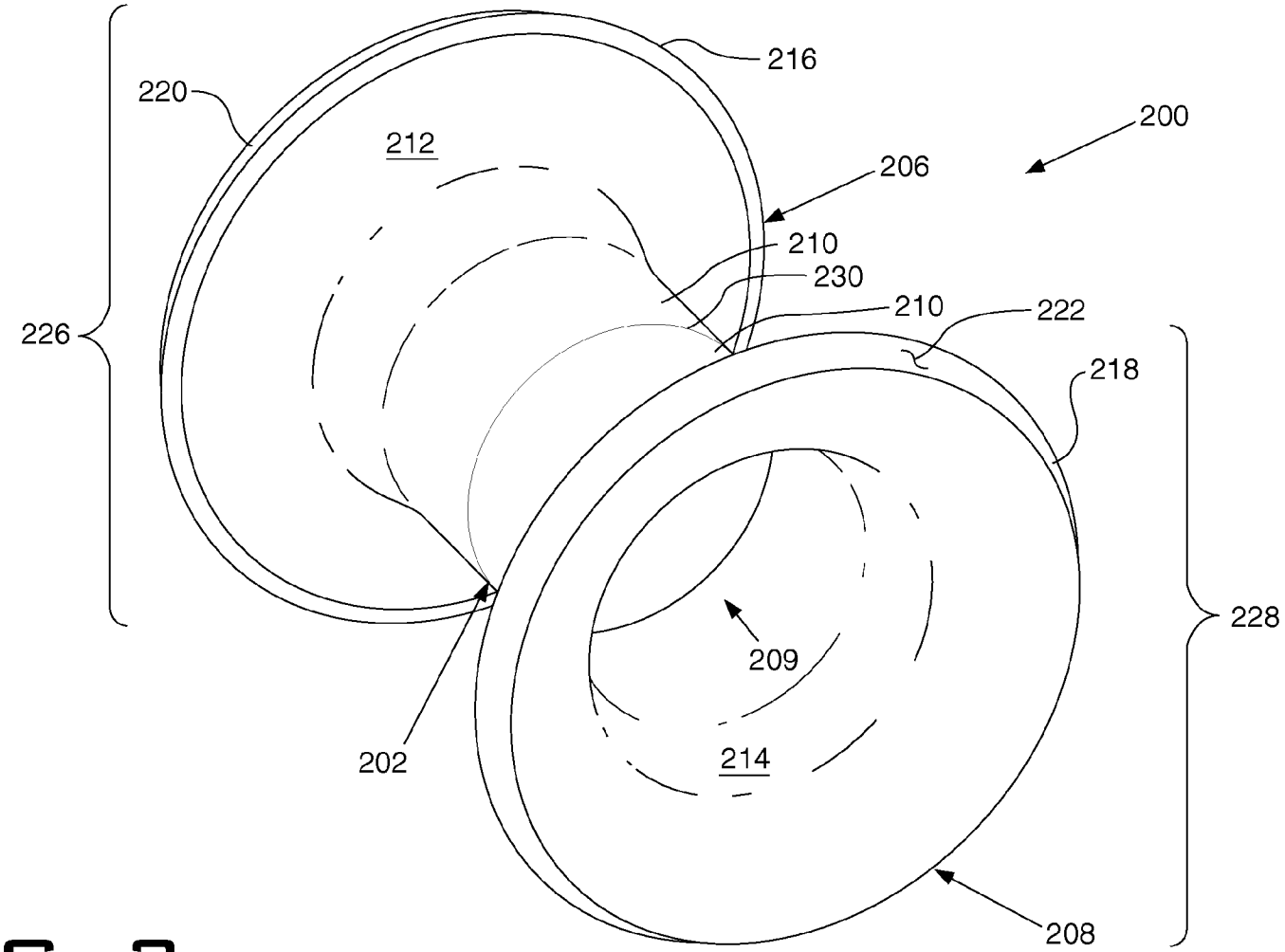
FIG. 3 is a perspective view of a reinforcement apparatus included in the boom of FIG. 2.
Figures 4, 5:
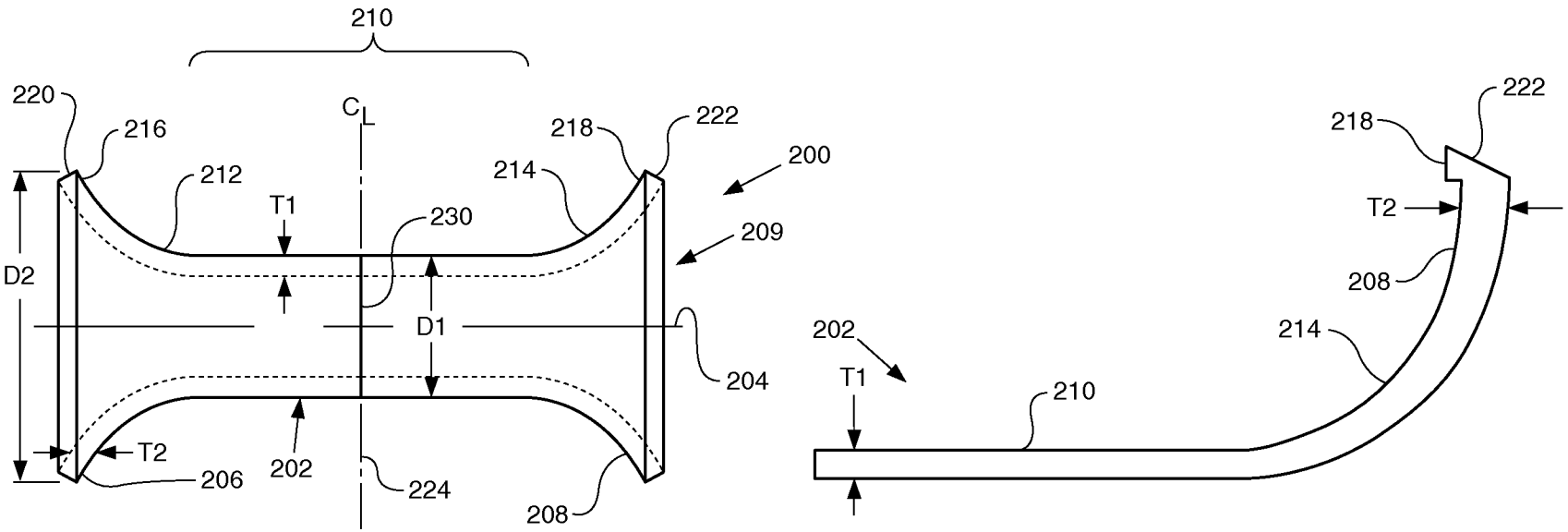
FIG. 4 is a side elevation view of the reinforcement apparatus of FIG. 3.
FIG. 5 is a detailed cross-section view of a portion of the tubular wall of the reinforcement apparatus of FIG. 4.

Referring to FIGS. 3 and 4, reinforcement device 200 includes a tubular wall 202 disposed about an axis 204. The tubular wall 202 is configured to include a first end 206 and a second end 208, with a throat portion 210 disposed between the first end 206 and the second end 208. The tubular wall defines a channel 209 through the reinforcement device 200 from the first end 206 to the second end 208. The throat portion 210 has an outside diameter D1. The first end 206 and the second end 208 each have an outside diameter D2 that is greater than outside diameter D1. Moving outward laterally from the throat portion 210 in both directions, the tubular wall 202 flares outward radially about axis 204 forming a first stress diffuser portion 212 disposed between the throat 210 and the first end 206 and a second stress diffuser portion 214 disposed between the throat 210 and the second end 208. The first and second stress diffuser portions 212, 214 may have a cross sectional profile of a curve, such as an arc, a parabola, or a hyperbola, giving the first and second stress diffuser portions 212, 214 a trumpet-shaped configuration. Alternatively, the first and second stress diffuser portions 212, 214 may be configured to have a linear cross sectional profile.

Reinforcement device 200 may also include a first rim 216 disposed about the circumference of the first end 206 and a second rim 218 disposed about the second end 208. Each rim 216, 218 may include a bevel edge 220, 222. The bevel edges 220, 222 are configured to cooperate with apertures 152, 154 in sidewalls 148, 150 to provide a weld bed between each rim 216, 218 and the respective sidewall 148, 150.

The tubular wall 202 of reinforcement apparatus 200 may vary in thickness from the throat 210 outward laterally to the first and second ends 206, 208, or may be of uniform thickness. A representative section of tubular wall 202, symmetrical about axis 204 and centerline 224 is shown in FIG. 5. In the disclosed embodiment, tubular wall 202 has a first thickness T1 at the throat 210. First thickness T1 may be uniform throughout the throat portion 210. The thickness of the tubular wall 202 increases as the tubular wall 202 transitions outwardly from the throat 210 to the second stress diffuser portion 214 until the thickness T2 is greatest at the second end 208. In the exemplary embodiment second thickness T2 is more than two times greater than first thickness T1. The trumpet-shaped configuration of first and second stress diffuser portions 212, 214 in combination with increasing wall thickness allows stresses produced by torsional loads to be diffused and distributed to the sidewalls 148, 150.

The reinforcement apparatus 200 disclosed herein may be of unitary construction or may be constructed from a pair of symmetrical tube segments 226, 228 joined at the centerline 224 of the reinforcement apparatus 200, as shown in FIG. 3. Each tube segment 226, 228 may have a profile as shown in FIG. 5, and as described previously herein. In the exemplary embodiment, the tube segments 226, 228 may be formed as a metal casting, for example carbon steel, aluminum, metal alloys, and the like. However, the tube segments may be formed by any acceptable metalworking method known in the art, such as rolling, forging, machining, spinning, and the like. Further, the reinforcement apparatus 200 may be formed by joining tube segments 226, 228 to a tubular member (not shown) therebetween, thereby forming an extended throat portion 210. Referring again to FIG. 3, reinforcement apparatus 200 may be constructed by joining together tube segments 226, 228 by a weld 230.

A load bearing structure, such as a boom 108 may be reinforced to provide enhanced rigidity against torsional loads by positioning a reinforcement apparatus 200 between the sidewalls 148, 150 such that the first end 206 and the second end 208 are in cooperation with the first and second apertures 152, 154, respectively. First and second ends 206, 208 of reinforcement apparatus 200 may be joined to the sidewalls 148, 150 by welding processes known in the art. A weld may be disposed about the first and second apertures 152, 154 thereby joining the first and second ends 206, 208 to the first and second sidewalls 148, 150, respectively. In an exemplary embodiment, first and second rims 216, 218 are welded to the first and second sidewalls 148, 150 at the first and second apertures 152, 154, respectively.

Reinforcement apparatus 200 may be provided as a unitary piece. Alternatively, reinforcement apparatus may be provided as an assembly constructed from a pair of tube segments 226, 228 joined together by welding before positioning the reinforcement apparatus 200 in cooperation with first and second apertures 152, 154. Alternatively, the first tube segment 226 may be positioned in cooperation with the first aperture 152 and welded in place. The second tube segment 228 may be positioned in cooperation with the second aperture 154 and welded in place. First tube segment 226 and second tube segment 228 then may be joined together by welding the throat portion 210 through the channel 209.

INDUSTRIAL APPLICABILITY

The disclosed reinforcement apparatus may be applicable to reinforce any box-beam type load bearing structure against torsional loads. In particular, the present reinforcement apparatus may be applicable to a linkage assembly of a machine, for example a boom or a stick attached to an excavator, backhoe, crane, loader, or similar machine. The disclosed reinforcement apparatus may provide torsional rigidity to a load bearing structure without the need for internal baffle plates and associated welding. The disclosed reinforcement apparatus allows access to weld points from outside of the load bearing structure, facilitating manufacture, inspection, and repair of the load bearing structure without the need to access internal regions of the structure.

It will be apparent to those skilled in the art that various modifications can be made to the disclosed reinforcement device without departing from the scope of the invention. Other embodiments of the reinforcement device will be apparent to those skilled in the art from consideration of the specification and the practice of the reinforcement device disclosed herein. For example, although the disclosed reinforcement device has been described primarily for use with excavators and other machines, it is contemplated that a similar reinforcement device may be used with any box-beam type load bearing structure subject to torsional loads. Additionally, although the disclosed reinforcement apparatus has been describes as including a pair of symmetrical cast wall segments welded together about a centerline, it is also contemplated that the reinforcement device may be formed as a unitary piece. It is intended that the specification and examples be considered exemplary only, with a true scope being indicated by the following claims and their equivalents.

What is claimed is:

1. A linkage assembly for a machine comprising:

a load bearing structure including:

a top plate;

a bottom plate spaced from the top plate;

a first sidewall attached to the top and bottom plates, and defining a first aperture; and a second sidewall spaced from the first sidewall, attached to the top and bottom plates, and defining a second aperture;

the top plate, bottom plate, first sidewall, and second sidewall forming a box-beam-type structure defining a hollow chamber;

an actuation joint extending through the box-beam-type structure; and a reinforcement apparatus separate from the actuation joint and extending through the hollow chamber from the first sidewall to the second sidewall, the reinforcement apparatus including a tubular wall including a first end, a second end, a throat portion disposed between the first end and the second end, and a stress diffuser portion disposed between the throat portion and each of the first end and the second end;

wherein the tubular wall has a first cross-sectional area dimension at the throat portion and a second cross-sectional area dimension at each of the first and second ends, the first cross-sectional area dimension being smaller than the second cross-sectional area dimension;

wherein the tubular wall has a first wall thickness at the throat portion and a second wall thickness at each of the first and second ends, the first wall thickness being smaller than the second wall thickness; and wherein the first end is arranged in cooperation with the first aperture and wherein the second end is arranged in cooperation with the second aperture.

2. The linkage assembly of claim 1 wherein the first end is joined to the first sidewall at the first aperture and the second end is joined to second sidewall at the second aperture.

3. The linkage assembly of claim 2 wherein the first end is joined to the first sidewall by a first weld disposed about the first aperture and the second end is joined to the second sidewall by a second weld disposed about the second aperture.

4. The linkage assembly of claim 1 wherein reinforcement apparatus comprises a first casting and a second casting, the first casting and second casting being joined at a centerline by a weld.

5. The linkage assembly of claim 4 wherein the tubular wall defines a channel, the weld being accessible through the channel.

6. The linkage assembly of claim 5 wherein the load bearing structure is a boom.

7. The linkage assembly of claim 5 wherein the load bearing structure is a stick.

* * * * *